US007428966B2

(12) United States Patent
Goodall et al.

(10) Patent No.: US 7,428,966 B2
(45) Date of Patent: Sep. 30, 2008

(54) KIT FOR PROVIDING WOUND WEB MATERIALS AND METHOD FOR MARKETING THE MATERIALS

(75) Inventors: John Patrick Goodall, Cincinnati, OH (US); Kara Marie Cain, Cincinnati, OH (US); Michael Bernard Dugas, Wyoming, OH (US); Donald William Yelton, Villa Hills, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 532 days.

(21) Appl. No.: 10/773,971

(22) Filed: Feb. 6, 2004

(65) Prior Publication Data

US 2005/0173281 A1 Aug. 11, 2005

(51) Int. Cl.
*B65D 71/00* (2006.01)

(52) U.S. Cl. ..... 206/225; 206/226; 206/391; 206/497

(58) Field of Classification Search ..... 206/389, 206/391, 392, 397, 225, 226, 233, 407, 408, 206/494, 459.5, 497; 242/598, 598.5, 598.6, 242/599, 599.1

See application file for complete search history.

(56) References Cited

U.S. PATENT DOCUMENTS

| | | | | |
|---|---|---|---|---|
| 2,628,713 | A * | 2/1953 | Diederich | 206/226 |
| 2,678,129 | A * | 5/1954 | Spector | 206/226 |
| 3,368,522 | A | 2/1968 | Cordis | |
| 3,756,483 | A | 9/1973 | Schraeder | |
| 3,770,118 | A * | 11/1973 | Jones | 206/226 |
| 3,834,636 | A * | 9/1974 | Linick | 242/598.5 |
| 3,843,034 | A | 10/1974 | Lewandowsky | |
| 4,638,921 | A | 1/1987 | Sigl et al. | |
| 5,464,170 | A * | 11/1995 | Mitchell et al. | 242/598 |
| 6,138,939 | A | 10/2000 | Phelps et al. | |
| 6,227,360 | B1 * | 5/2001 | Kessler | 206/226 |
| 6,273,359 | B1 | 8/2001 | Newman et al. | |
| 6,382,552 | B1 | 5/2002 | Paul et al. | |

FOREIGN PATENT DOCUMENTS

| | | | |
|---|---|---|---|
| EP | 1 024 093 | B1 | 7/2004 |
| GB | 2 380 178 | A | 4/2003 |
| WO | WO 00/65973 | A1 | 11/2000 |
| WO | WO 00/65975 | A1 | 11/2000 |
| WO | WO 01/76436 | A1 | 10/2001 |
| WO | WO 01/76438 | A1 | 10/2001 |
| WO | WO 01/76439 | A1 | 10/2001 |
| WO | WO 01/76440 | A1 | 10/2001 |
| WO | WO 01/82765 | A1 | 11/2001 |
| WO | WO 01/89937 | A2 | 11/2001 |
| WO | WO 02/21988 | A1 | 3/2002 |
| WO | WO 02/32281 | A1 | 4/2002 |
| WO | WO 02/41742 | A1 | 5/2002 |
| WO | WO 02/43546 | A1 | 6/2002 |
| WO | WO 02/43547 | A1 | 6/2002 |

* cited by examiner

*Primary Examiner*—Luan K Bui
(74) *Attorney, Agent, or Firm*—Peter T. Nguyen; Peter D. Meyer; David K. Mattheis

(57) ABSTRACT

A kit providing at least one roll of a convolutely wound web material and at least one roll-support adapter and a method of marketing the kit. The roll-support adapter interfaces with an existing roll-holding fixture to increase the single roll capacity of the roll holder and to hold and dispense the roll of convolutely wound web material. The kit may provide rolls having a diameter larger than the capacity of the existing roll-holding fixture.

10 Claims, 10 Drawing Sheets

KIT FOR PROVIDING WOUND WEB MATERIALS AND METHOD FOR MARKETING THE MATERIALS

FIELD OF THE INVENTION

This invention relates to providing wound-roll web materials to shoppers and consumers. The invention relates in particular to the provision of large-diameter roll web materials together with an adapter to facilitate the dispensing of the web material of the large-diameter rolls from existing roll-holding fixtures.

BACKGROUND OF THE INVENTION

Web materials, such as plastic wraps, aluminum foil, trash bags, bath tissue and paper towels are well known. These materials are commonly provided as a convolutely wound roll of the web material. The roll of material may be disposed on a horizontally oriented spindle of a roll-holding fixture to facilitate the rotation of the roll and the dispensing of the material for use.

Inevitably, the material of the roll is exhausted and the roll must be replaced with a subsequent roll. Large diameter rolls of the material may provide the benefit of an increased quantity of material per roll and an accompanying increase in the time between roll replacement. The large diameter of these increased capacity rolls can be problematic due to the limited capacity of the existing roll-holding fixtures. The existing fixtures are capable of holding and dispensing rolls across a range of diameters, but that range is limited. As an example, rolls of bath tissue having a diameter in excess of 4.8 inches (12.2 cm) are typically at the upper limit, or outside the range that can be accommodated by common installed bath tissue roll-holding fixtures. These rolls either do not fit in existing holders or do not dispense bath tissue efficiently until sufficient tissue has been removed from the roll to reduce the roll diameter to a diameter that the roll-holding fixture can accommodate.

Effectively marketing an increased capacity, large diameter, wound-roll consumer product is at least partially dependent upon consumer acceptance of the larger roll diameter. This consumer acceptance is in turn at least partially dependent upon the ease with which the large diameter rolls may be held, and the web material dispensed from the rolls. One way to increase the range of roll diameters that can be effectively held and dispensed is to replace the existing roll-holding fixtures. Another way is to adapt the existing roll-holding fixture to accept the large diameter rolls. Consumers are more likely to try a larger diameter roll product that does not require the replacement of an existing roll-holding fixture. Therefore this invention seeks to provide a means of enabling the use and acceptance of a large diameter roll of a consumer web material.

SUMMARY OF THE INVENTION

A kit facilitates the marketing and use of large diameter rolls of convolutely wound web materials. In one embodiment, the kit comprises a convolutely wound roll of a web material and a roll-support adapter. The diameter of the roll may be larger than a standard roll, and larger than the capacity of an existing roll-holding fixture, to provide a greater quantity of the web material than is provided with a standard roll. The roll may be provided with a smaller than typical core, or no core at all, to further increase the capacity of the roll. The roll-support adapter facilitates the use of the roll with an existing roll holder. The roll-support adapter may increase the single roll capacity of the existing roll holder. The roll-support adapter may be fixedly or releasably attached to the existing roll holder. In another embodiment, the kit comprises multiple rolls of web material and at least one roll support adapter. In another embodiment the kit comprises multiple roll-support adapters and at least one roll of web material.

In another aspect, the invention comprises a method of marketing large diameter rolls of web material. In addition to providing the kit as described above, advertising of various forms, and point of sale materials, may be used to inform the shopper as to the increased quantity of web material per roll and as to the inclusion of the roll-support adapter to facilitate the use of the larger roll with an existing roll-holding fixture. The installation and use of the roll-support adapter may also be illustrated and described on the package and/or in the point of sale materials. These steps may facilitate educating the shopper as to the benefits and use of the contents of the kit. The marketing of the large diameter rolls may further include the provision of large rolls individually, and in multiple roll packs without an accompanying roll-support adapter to enable the ongoing purchase and use of the rolls by shoppers who have previously acquired a roll-support adapter. The marketing method may further include the step of providing the roll-support adapter individually or in multiple adapter roll-support adapter packs to enable the purchase by the shopper of the desired number of roll-support adapters.

BRIEF DESCRIPTION OF THE DRAWINGS

While the claims hereof particularly point out and distinctly claim the subject matter of the present invention, it is believed the invention will be better understood in view of the following detailed description of the invention taken in conjunction with the accompanying drawings in which corresponding features of the several views are identically designated and in which:

DETAILED DESCRIPTION OF THE INVENTION

Figure 1:
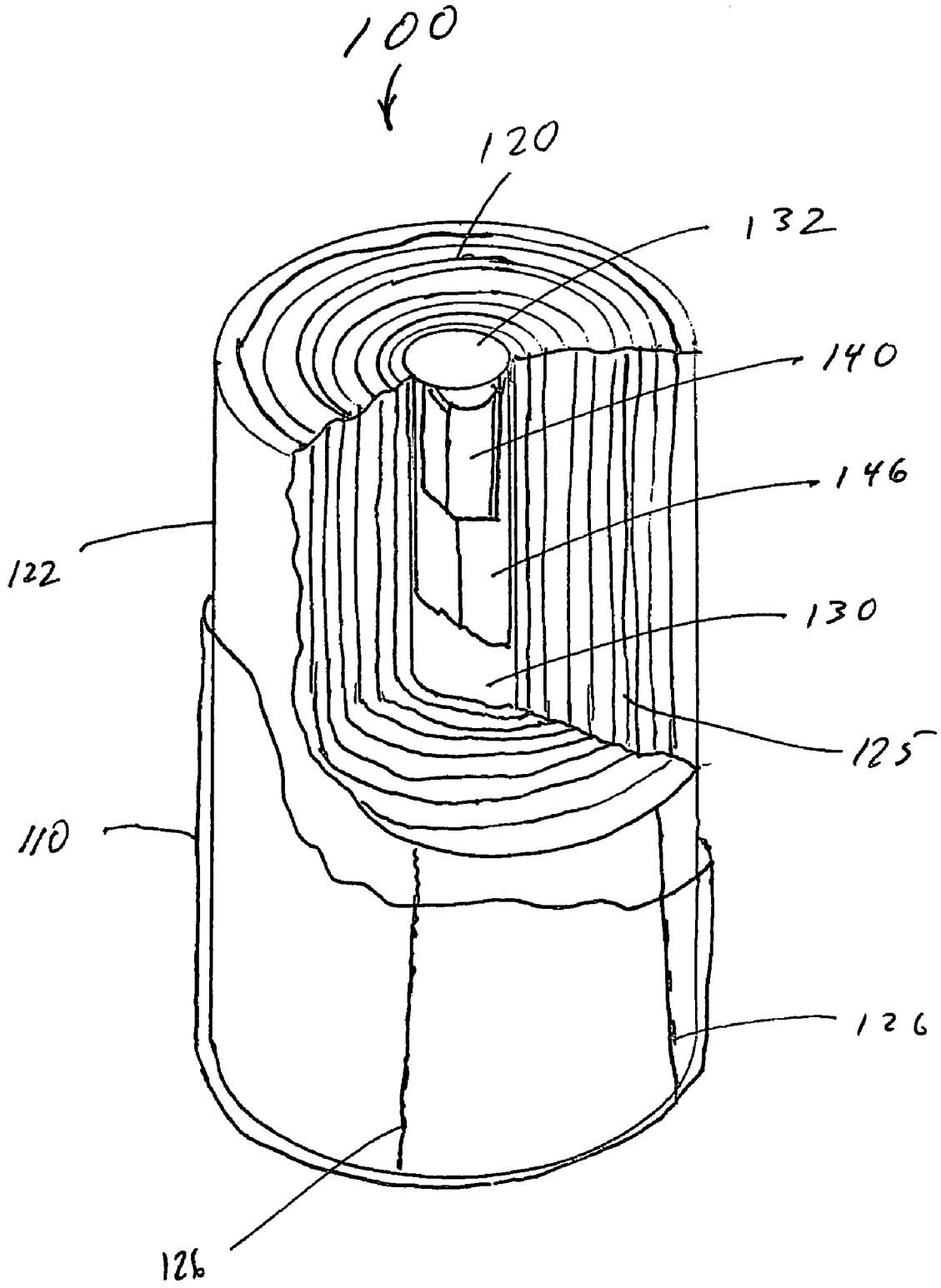
FIG. 1 is a schematic illustration of the contents of a kit according to one embodiment of the invention. The kit of the figure is shown partially cut away to more clearly show the contents of the kit.

The kit:

The kits of the present invention may be used to provide any convolutely wound web material. The following description of the invention is in terms of providing convolutely wound rolls of bath tissue. The invention is not to be construed as limited to the provision of bath tissue and may be used to provide plastic or metal films, bags formed of any type of web material, other grades of paper webs and similar web materials. As illustrated in FIG. 1, the kit 100 comprises at least one roll 120 of a convolutely wound web material 125, and a roll-support adapter 140. The roll 120 may be wound about a hollow core 130, or the roll 120 may be coreless. The web material 125 may further comprise lines of weakness 126 across the width of the web material 125 to facilitate the dispensing of a portion of the roll 120 by the consumer. These lines of weakness 126 are well known in the art and will not be more fully described here.

For bath tissue, the diameter of the roll 120 may be between about 4 inches, (10.2 cm) and about 12 inches (30.5 cm). In one embodiment, the diameter of the roll 120 may be between about 5 inches (12.7 cm) and about 8 inches (20.4 cm) in coordination with the type of roll-support adapter 140 provided in the kit 100. Other roll diameters may be provided to correspond to other roll-support adapter 140 designs, or to correspond to the consumers' needs and/or the desires of the marketer. The diameter of the roll 120 may be larger than the maximum single roll diameter acceptable by an existing roll-holding fixture. The maximum single roll diameter acceptable by an existing roll holding fixture is considered the single roll capacity of the fixture.

The unitized kit 100 may be at least partially enclosed by a package 110. The package 110 may comprise a polymeric, Mylar™, cellulosic, or metalized film, a paperboard or corrugated cardboard container, or other containers as are known in the art. The material of the package 110 may be capable of being printed upon, embossed or otherwise marked with indicia. The kit 100 may comprise a plurality of rolls 120 of web material 125. The plurality of rolls 120 may be column stacked in a single or multiple columns, or the plurality may be arranged in a planar array. As a non-limiting example, the kit may comprise 12 rolls of web material provided as four columns of three rolls 120 per column. In another embodiment, a single roll 120 may be provided with a roll-support adapter 140 disposed in the core 130 of the roll 120, or otherwise attached to the roll 120.

In an embodiment illustrated in FIG. 1, the roll-support adapter 140 is disposed within an adapter container 146. As illustrated in the figure, the adapter container 146 and roll-support adapter 140 are disposed together within the hollow core 130 of the roll 120. In this embodiment, the adapter container 146 may be constrained within the hollow core by one or more covers 132 releasably attached to the ends of the core 130. The cover 132 may be removed by the consumer to facilitate the removal of the adapter container 146 and roll-support adapter 140 from the core 130 for the subsequent installation and use of the roll-support adapter 140 and roll 120. The cover 132 may be attached to the core 130 and or roll 120 by means of an adhesive, by mechanically coupling with the core 130, or by other fastening means as are known in the art. One cover 132 may be attached to the adapter container 146 to stabilize the position of the container in the package 110. The roll-support adapter 140 may be disposed in the core 130 of the roll 120 without the adapter container 146.

The adapter container 146 may be a regular prism having a triangular, quadrilateral, pentagonal, hexagonal, heptagonal, octagonal, or other regular geometric cross section. In another embodiment, the adapter container 146 may have and irregular cross section. The adapter container 146 may be closed at one or both ends to constrain the movement of the roll-support adapter 140. The adapter container 146 may comprise a bag formed of paper, chipboard, corrugated cardboard, metal, plastic film, metal foil, or other packaging materials. The material of the adapter container 146 may be printed or embossed or otherwise marked with indicia. The adapter container 146 may be sealed to prevent unintentional removal of the roll-support adapter 140 from the adapter container 146. The length of the adapter container 146 may require that the roll-support adapter 140 be compressed along an axis of the roll-support adapter 140 to facilitate the disposition of the roll-support adapter 140 within the adapter container 146. In another embodiment, the adapter container 146 may be longer than the roll-support adapter 140. In this embodiment, the roll-support adapter 140 may be disposed within the adapter container 146 without being compressed along the axis of the roll-support adapter 140.

Figure 2:
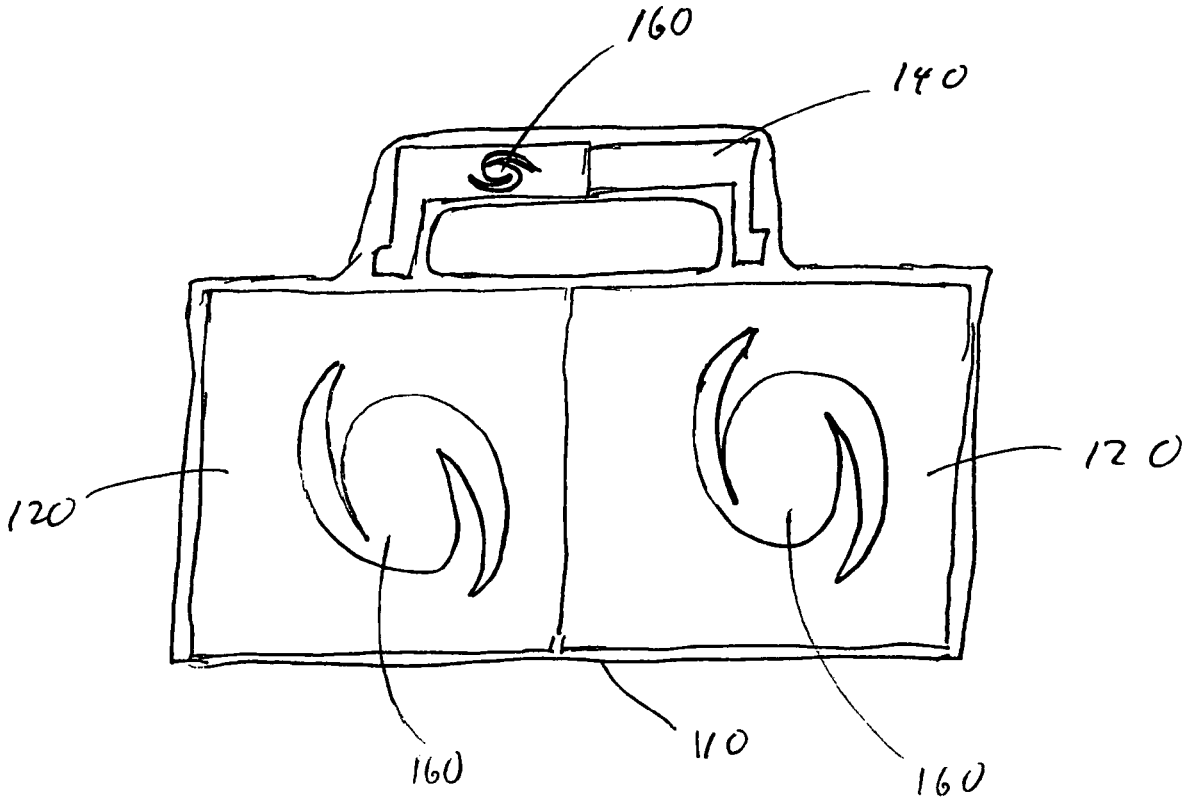
FIG. 2 is a schematic side view of a kit according to an embodiment of the invention.

In one embodiment of the kit 100, illustrated in FIG. 2, the roll-support adapter 140 may be incorporated as a carrying handle for the package 110. In one embodiment, the roll-support adapter 140 may be affixed to the roll 120 by wrapping the roll 120 and adapter 140 in stretch wrap film. In another embodiment, the roll-support adapter 140 may be affixed to the roll 120 of web material through the use of a shrink-wrap film as is known in the art. In another embodiment, the roll-support adapter 140 may be attached to the roll 120 by a wire, string, cord or polymeric strap. In still another embodiment, the roll-support adapter 140 may be attached to the roll 120 by an adhesive, or cohesive material. Other joining means as are known in the art may also be used to combine the roll-support adapter 140 and the roll 120. The kit 100 may comprise a plurality of roll-support adapters 140.

Figure 3A:
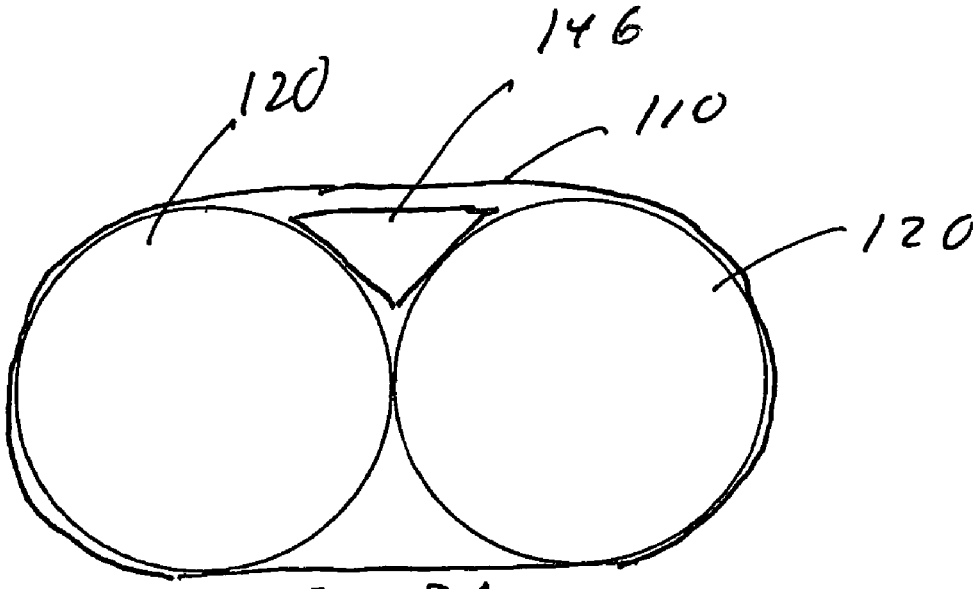
FIG. 3A is a schematic cross sectional view of a kit according to another embodiment of the invention.
Figure 3B:
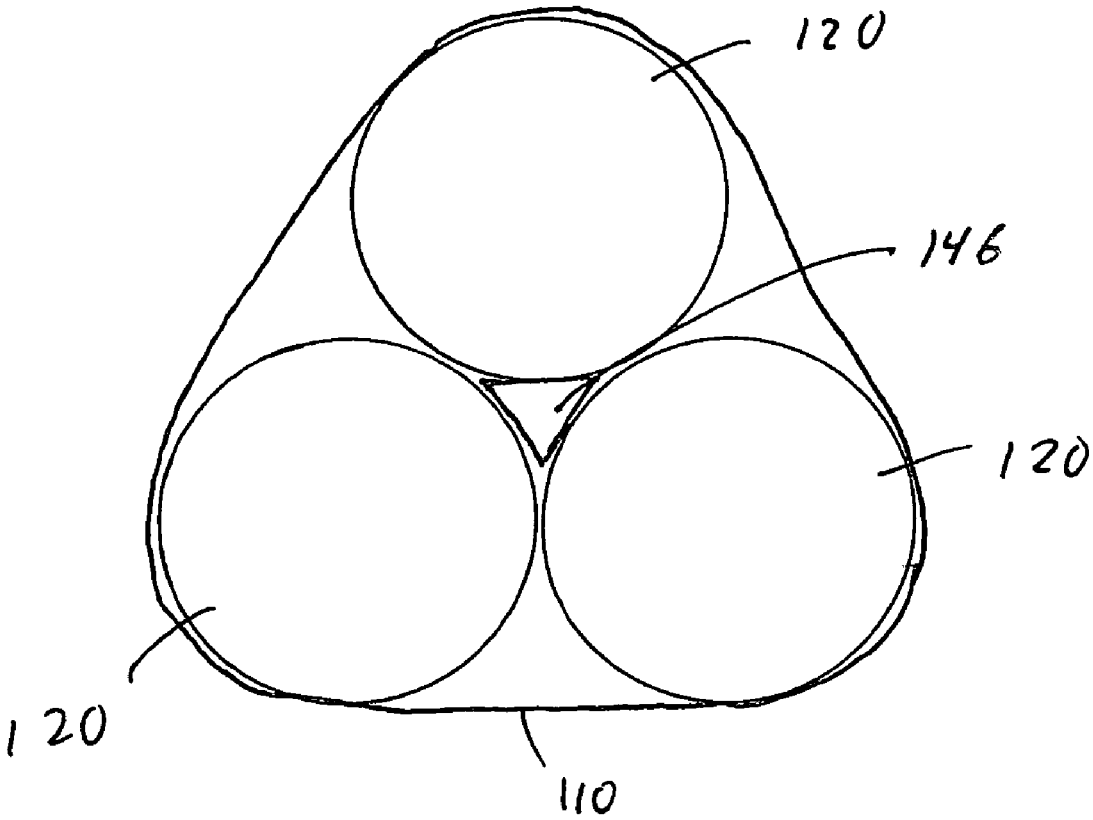
FIG. 3B is a schematic cross sectional view of a kit according to another embodiment of the invention.
Figure 3C:
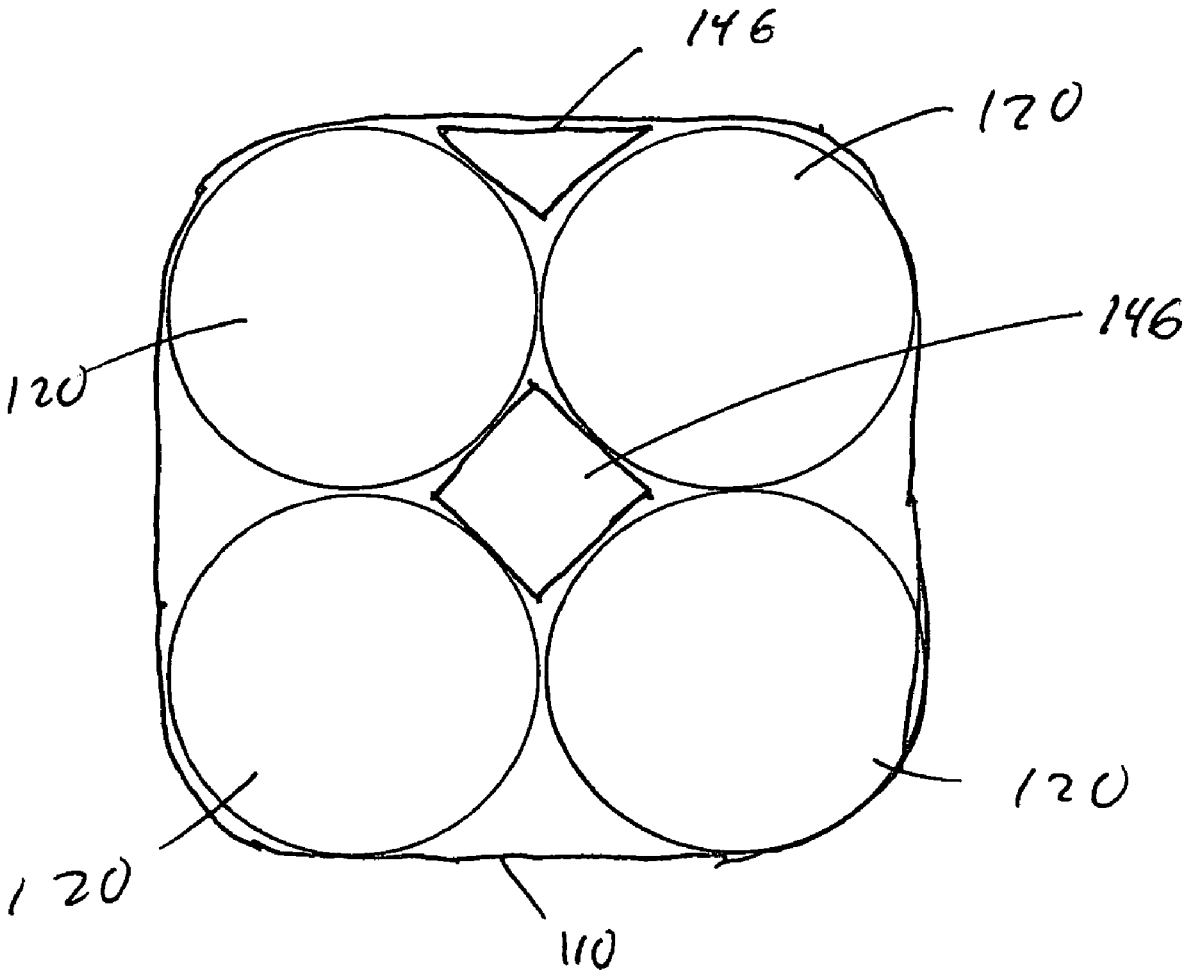
FIG. 3C is a schematic cross sectional view of a kit according to yet another embodiment of the invention.

In one embodiment the roll-support adapter 140 may be disposed in the cleft area between multiple rolls 120, or multiple columns of rolls 120 comprising the kit 100. The roll-support adapter 140 may be disposed in an adapter container 146 as described above or may be disposed in the package 110 without an adapter container 146. The adapter container 146 may be a regular prism or a bag as described above. The adapter container 146 may be disposed in the cleft between two rolls or columns of rolls 120 as shown in FIG. 3A. In another embodiment illustrated in FIG. 3B, the adapter container 146 may be disposed in the cleft between three rolls 120, or three columns of rolls 120. In another embodiment illustrated in FIG. 3C, the adapter container 146 may be disposed in the cleft between four rolls 120, or four columns of rolls 120.

Figure 4:
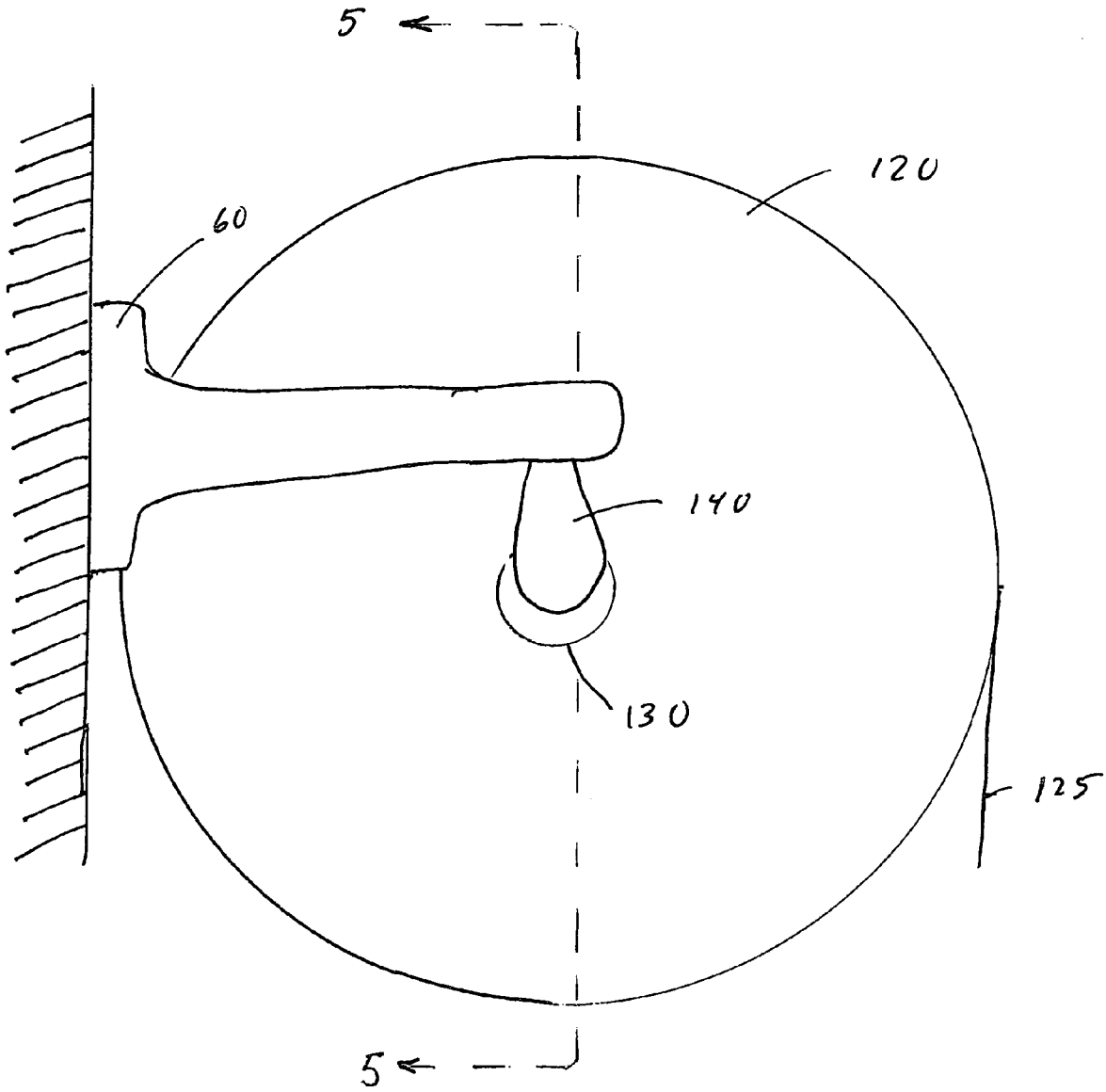
FIG. 4 is a schematic side view of an existing roll holder, a roll-support adapter and a roll of web material according to the invention.

FIG. 4 illustrates a roll 120 of web material supported by a roll-support adapter 140 attached to an existing roll-holding fixture 60. The diameter of the roll 120 may preclude an existing roll-holding fixture 60 from holding the roll 120, or from allowing the roll 120 to rotate for dispensing the web material 125. The figure illustrates the use of a roll-support adapter 140 that is provided together with the roll 120 to facilitate the rotation of the roll 120 and the dispensing of the web material 125. The roll-support adapter 140 is capable of interfacing with the existing roll-holding fixture 60 and concurrently supporting the roll 120.

The kit 100 may comprise the package 110 at least partially enclosing at least one roll 120 of web material 125, together with the adapter container 146 at least partially enclosing the roll-support adapter 140. The adapter container 146 may be joined to the package 110 by adhesive or thermal bonding, by a mechanical bond such as a staple, wire, string, cord, strap, or other fastener. The package 110 and the container 140 may be unitized by over-wrapping the combination with stretch or shrink film.

The Roll:

The roll 120 may comprise any convolutely wound web material 125. The web material may be formed, printed, embossed or otherwise marked with indicia. The web material 125 may be wound about a core 130. The core 130 may comprise an extruded thermoplastic resin, a wound and overlapping tube of one or more layers comprised of paperboard or other flexible materials, a wooden, metal, glass, or composite material sleeve. The web material 125 may be adhered to the core 130 or wound on the core 130 without adhering to the core 130. Alternatively, the roll 120 may comprise a web material 125 wound about itself without a core 130. The tail of the roll 120 may be sealed or unsealed as is known in the art. The diameter of the roll may be typical for the web material 125. Alternatively, the diameter of the roll may be larger than typical and may be larger than the largest diameter that can be accommodated by a typical existing roll-holding fixture 60 for the particular web material 125.

Figure 5A:
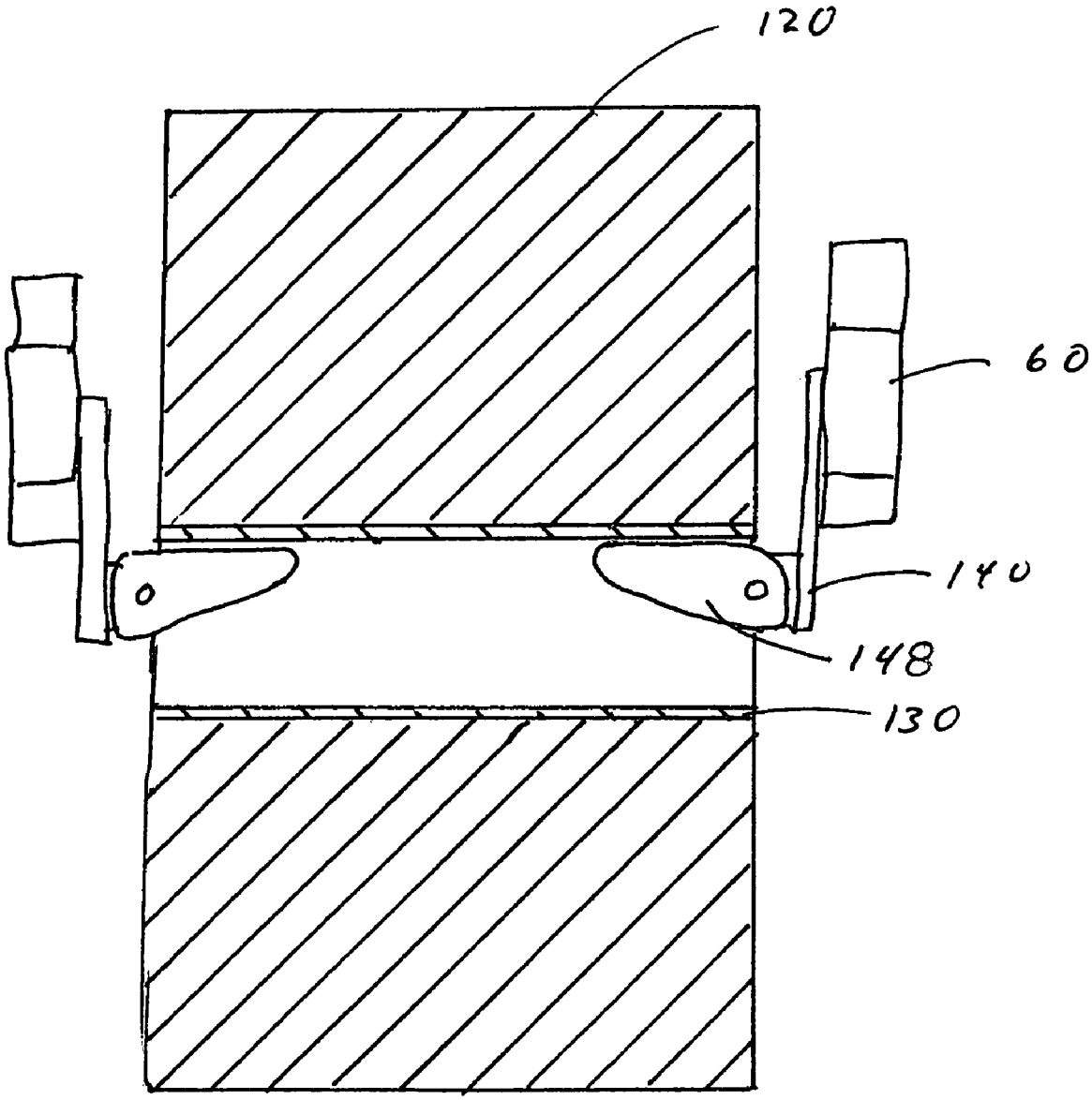
FIG. 5A is a schematic front view of an existing roll holder, a roll-support adapter, and a roll according to one embodiment of the invention. The figure shows a view with a cross section through the roll.

The Adapter:

The roll-support adapter 140 interfaces with an existing roll support fixture 60 to provide support for the roll 120 of web material 125. The roll-support adapter may increase the single roll capacity of the roll support fixture. The roll-support adapter 140 may be fixedly or releasably attached to the existing roll-holding fixture 60. As shown in FIG. 5A, the roll-support adapter 140 may support the roll 120 by engaging each end of the core 130 of the roll 120 directly. A typical existing roll-holding fixture 60 engages the core of the roll via a spindle. The roll-support adapter 140 may comprise spring-loaded, or gravity-actuated core-engaging extensions 148 that engage the ends of the core 130 of the roll 120 and thereby support the roll 120. These core-engaging extensions 148 are capable of disengaging the core 130 when the consumer wants to replace the roll 120.

Figure 5B:
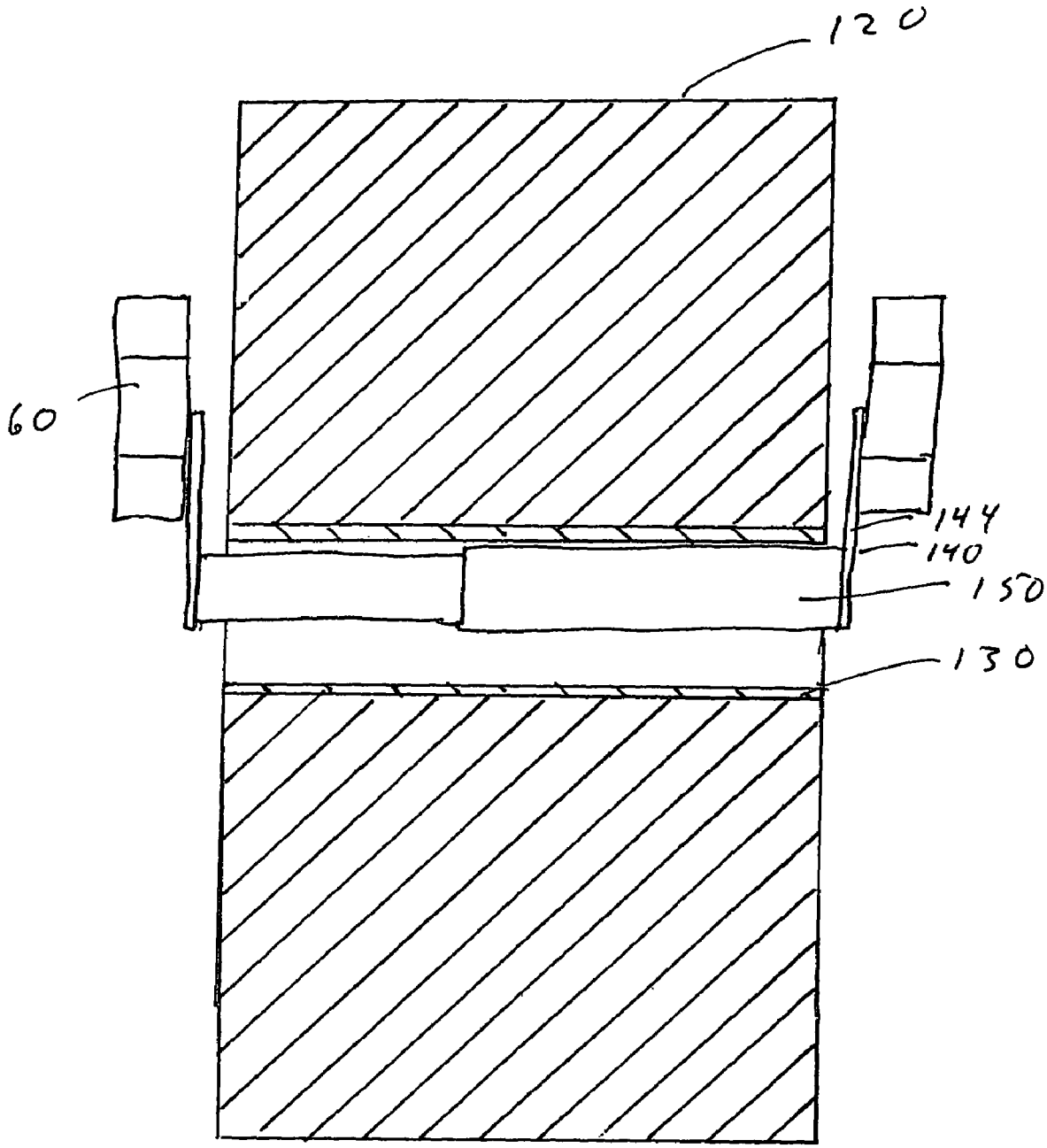
FIG. 5B is a schematic front view of an existing roll holder, a roll-support adapter, and a roll according to another embodiment of the invention. The figure shows a view with a cross section through the roll.

In another embodiment, illustrated in FIG. 5B, the roll-support adapter 140 may support the roll 120 by engaging a support spindle 150 capable of supporting the roll 120 through its core 130. The spindle 150 may be provided together with the roll 120 as part of the roll-support adapter 140, or the spindle 150 may be an existing spindle 150 possessed by the consumer. In this embodiment, the roll-support adapter 140 may comprise a plurality of extension elements 144. Each respective extension element 144 being capable of being fixedly or releasably attached to a separate portion of an existing roll-holding fixture 60. The extension elements 144 may be attached to the existing roll-holding fixture by the use of adhesives, by the mechanical engagement of the extension elements 144 with the fixture 60, by mechanical fasteners such as rivets or screws, or by other fastening means as are known in the art.

Figure 5C:
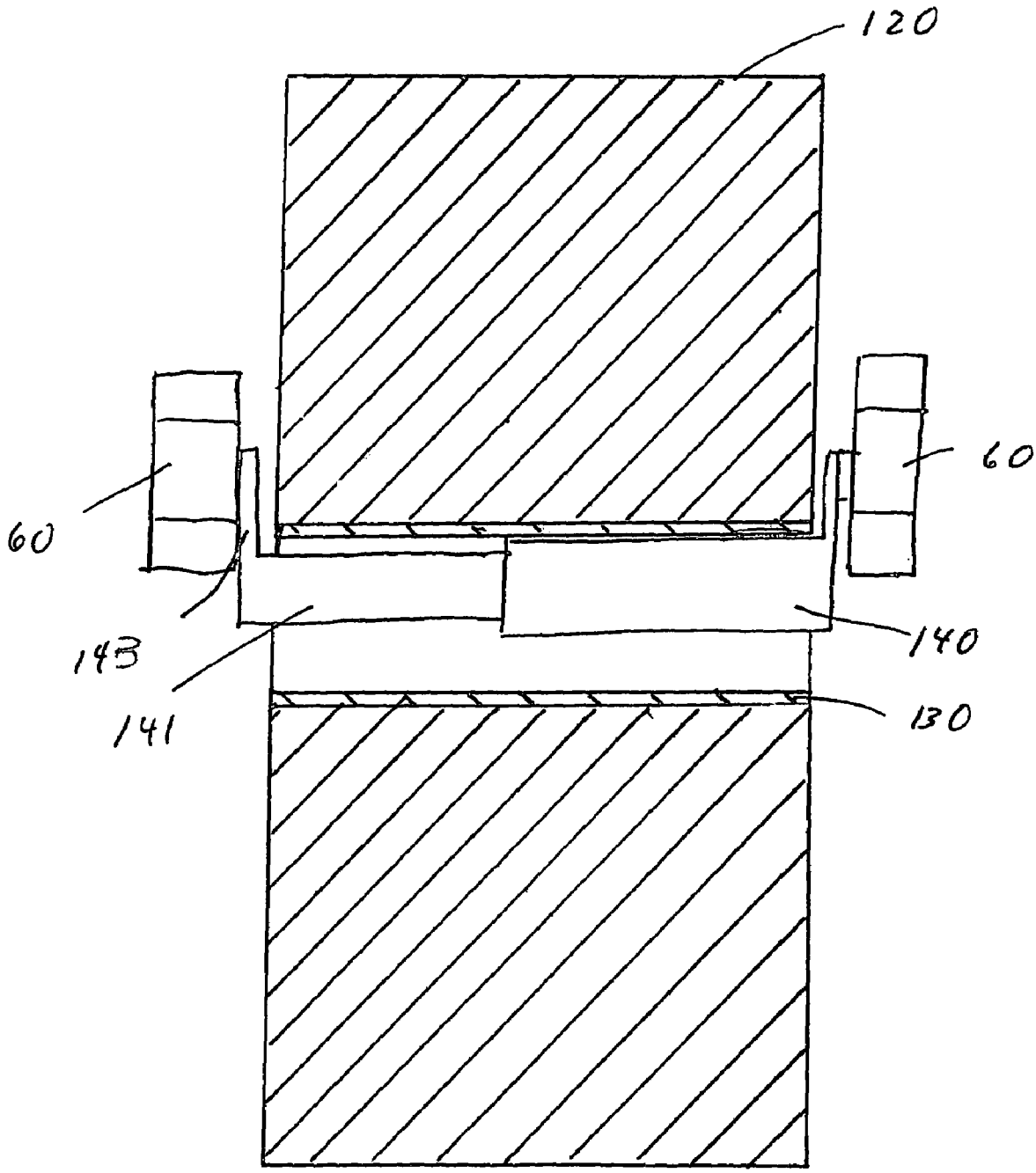
FIG. 5C is a schematic front view of an existing roll holder, a roll-support adapter, and a roll according to another embodiment of the invention. The figure shows a view with a cross section through the roll.

In another embodiment illustrated in FIG. 5C, the roll-support adapter 140 may function as a roll support spindle and also releasably engage the existing roll-holding fixture 60. This adapter 140 may comprise a spindle portion 141 comprising a first end and a second end, and extensions 143 on each end of the spindle portion 141. The extensions 143 may be generally perpendicular to the axis of the spindle portion 141. The extensions 143 may fixedly or releasably engage the existing roll-holding fixture 60 at a distance from the spindle portion 141. The length of the extensions 143 between the axis of the spindle portion 141 and the point of engagement of the existing roll-holding fixture 60, offsets the position of the roll support and enables the use of a larger diameter roll 120 than is possible when using the existing roll-holding fixture 60 without roll-support adapter 140.

In this embodiment the roll-support adapter 140 may be spring loaded along the axis of the spindle portion 141 to bias the extensions 143 away from each other and to thereby provide a force directed outward toward the existing fixture 60 to maintain the engagement of the extensions 143 with the fixture 60. In another embodiment, the roll-support adapter 140 may be mechanically adjustable as to the length of the spindle portion 141 between the extensions 143. This mechanical adjustment may be accomplished by a threaded means or other means of variably interlocking portions of the spindle portion 141 to achieve differing lengths between the extensions 143 of the roll-support adapter 140. In these embodiments, the material of the extensions may be resilient to flex inward during the installation into, and removal from the existing fixture 60, of the roll-support adapter 140.

Figure 6:
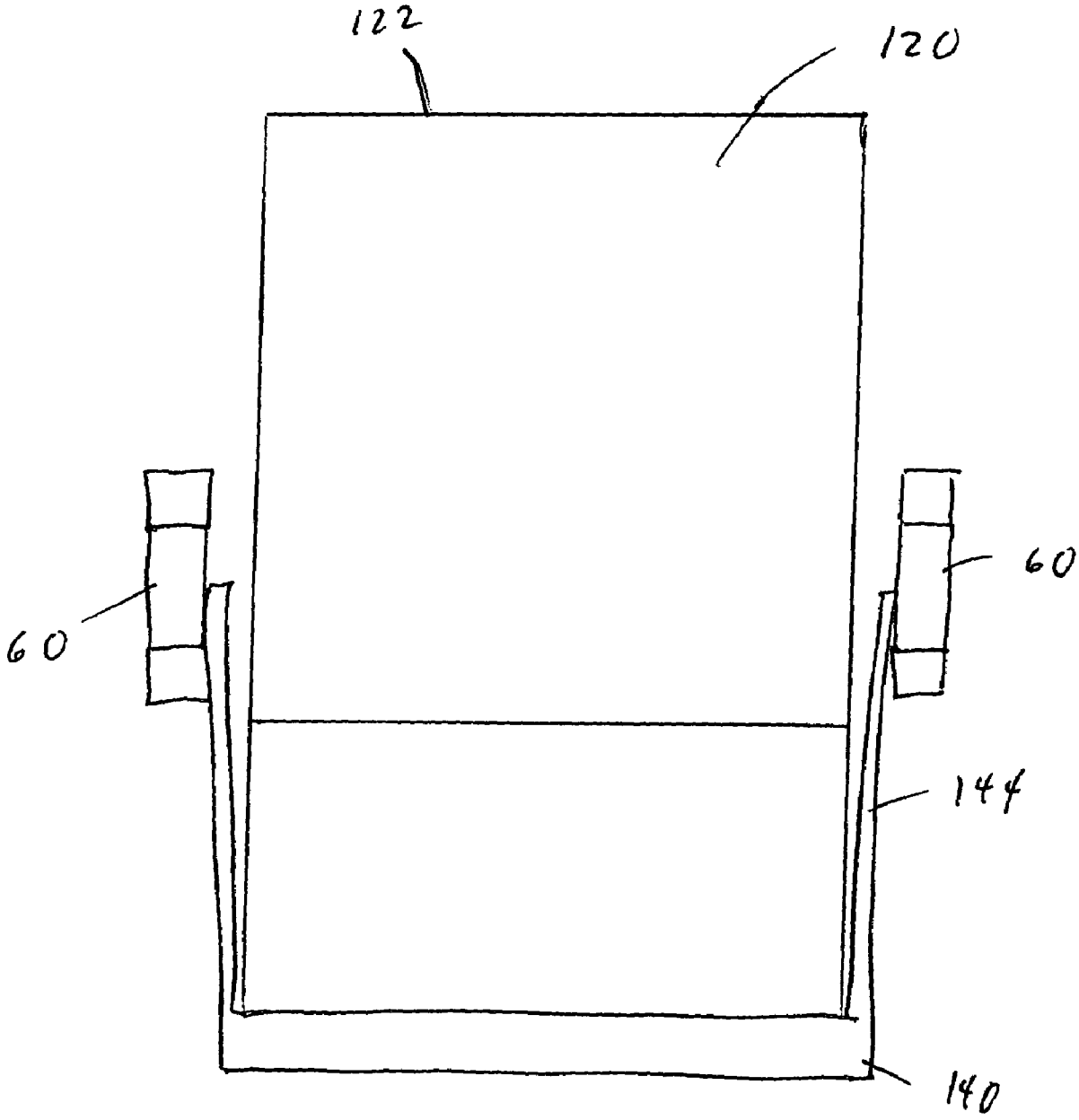
FIG. 6 is a schematic front view of an existing roll holder, a roll-support adapter, and a roll according to another embodiment of the invention.

In another embodiment illustrated in FIG. 6, the roll-support adapter 140 may be capable of interfacing with the existing roll-holding fixture 60 and capable of supporting a cored or coreless roll 120 of web material 125. The roll-support adapter 140 of this embodiment facilitates the rotation of the roll 120 and the dispensing of the web material 125 by supporting a circumferential surface 122 of the roll 120. The roll-support adapter 140 also engages the existing roll-holding fixture 60.

Figure 7:
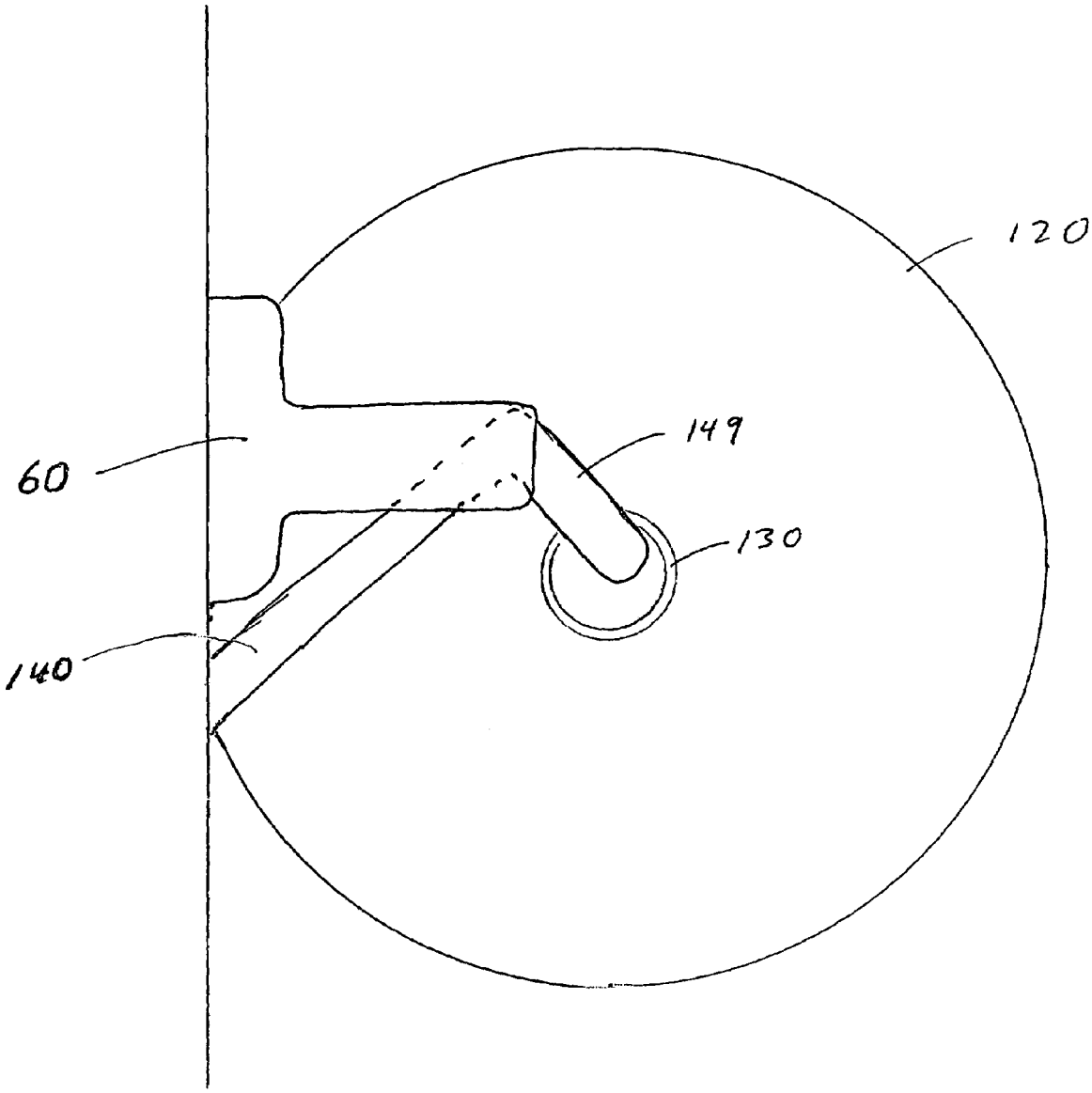
FIG. 7 is a schematic side view of an existing roll holder, a roll-support adapter and a roll of web material according to one embodiment of the invention.

In another embodiment illustrated in FIG. 7, the roll-support adapter 140 may be fixedly or releasably attached to the existing roll-holding fixture 60 and capable of releasably supporting the roll 120 by the core 130 of the roll 120 or capable of releasably engaging a roll support spindle 150. In this embodiment, the roll-support adapter 140 may engage the existing roll-holding fixture 60 and be maintained in a first position by the combination of the engagement with the fixture 60 and the weight of the roll 120. When the roll 120 is removed, pending replacement with a subsequent roll 120, the roll-support adapter 140 may pivot to a second position in the absence of the weight of the roll 120 acting upon the roll-support adapter 140. In this embodiment, the second position may facilitate the replacement of the roll 120. In this embodiment, the roll-support adapter 140 comprises extensions 149. Extensions 149 may be adapted to engage the core 130 of the roll 120 directly or to engage the core via a spindle 150.

The roll-support adapter 140 may be configured to dispense a lotion or other material for use in conjunction with the web material 125 or for use apart from the web material 125. The lotion may be dispensed by way of gravity, or by the use of a pump. The pump may be mechanically or electrically actuated. The roll-support adapter 140 may be configured to emit a scent at the discretion of the consumer, or to continuously emit a scent. In another embodiment, the adapter may be capable of sensing the motion of the roll 120 and emitting a scent upon the commencement, over the duration, or upon the cessation, of the motion, or combinations of the above. The roll-support adapter 140 may comprise a scented element that is permanently or selectively vented to release the scent. In another embodiment, the roll-support adapter 140 may comprise a mechanically or electrically actuated pump coupled to a scent reservoir. The pump may be activated at the discretion of the consumer, upon sensing the motion of the roll 120 as described, or both.

The roll-support adapter 140 may be fabricated from a broad range of materials including, but not limited to: metal, glass, wood, polymeric materials, carbon fiber composites and other composite materials. The materials of the adapter may be etched, printed, machined, molded or otherwise marked with indicia. The roll-support adapter 140 may be provided in a broad range of colors and surface patterns. Any of the above described roll-support adapters, as well as other roll-support adapters as are known in the art, may be provided as a component part of the kit 100.

The kit may comprise indicia upon one or more kit components as described. The indicia 160 as illustrated in FIG. 2 may be similar or dissimilar. Indicia 160 related in appearance or nature are considered similar. Similar indicia may be identical. The indicia 160 may convey brand name or other information about the web material 125 or the roll-support adapter 140.

One of skill in the art would appreciate that the roll-support adapter embodiments described above are exemplary and do not limit the invention.

The Marketing Method

In one embodiment, the marketing method comprises steps of providing a large capacity roll 120 of web material 125 together with a roll-support adapter 140 to facilitate the convenient and efficient dispensing of the web material 125. The roll-support adapter 140 and the roll 120 may be provided together in a kit 100. The kit 100 may provide a single roll 120 of web material 125 or may provide multiple rolls 120 of web material 125. The kit 100 may provide a single roll-support adapter 140 or may provide multiple roll-support adapters 140. The roll 120 and the roll-support adapter 140 may be provided together to assuage the concerns of the shopper relating to the compatibility of the large capacity and diameter rolls 120 with any existing roll-holding fixtures 60.

The marketing method may be used to market any web material provided to the consumer as a convolutely wound roll 120. Exemplary web materials include bath tissue, paper toweling, hard grades of paper, such as butcher paper, polymeric films, metalized films, aluminum foils, and other metal foils. Products made from such web materials, such as bags may also be provided as convolutely wound rolls 120 through the use of the marketing method. The web material 125 may comprise lines of weakness 126 generally transverse to the width of the web material 125 as such lines of weakness 126 are known in the art.

The marketing of the kit 100 may include providing a communication of the increased material capacity of the roll 120. The communication may be visual, auditory or tactile. The provision and use of the roll-support adapter 140 to enable the use of a large diameter roll with an existing roll-holding fixture may be illustrated aurally, graphically, textually, and/or tactilely at the point of sale and in other advertising copy relating to the kit 100. The provision and use of the roll-support adapter 140 may be illustrated and/or described on the package 110 of the kit 100.

The marketing method may further include advertising through various media channels, including but not limited to, print, direct mail, television, internet, and radio. The advertising copy may comprise communicating the availability of the large capacity rolls 120, the consumer benefits of such rolls, and the ease of using the large diameter roll 120 because of the inclusion of the roll-support adapter 140 with the roll 120.

The marketing method may include providing the rolls 120 and the roll-support adapter 140 as separate purchasable items in addition to providing kits 100 in a unitized package. The provision of separate items enables the shopper to tailor their purchases so as to acquire the number of roll-support adapters 140 desired and to acquire additional rolls 120 of web material 125, or additional roll-support adapters 140 as required.

The marketing method may comprise the provision of the roll 120 and the roll-support adapter 140 in the form of an effective kit. Providing an effective kit describes providing the shopper with a roll-support adapter 140 and at least one roll 120 without providing the roll 120 and adapter 140 in a single unitized package 110. In one embodiment, an effective kit may be provided by providing a coupon or voucher together with a package of rolls 120 of the web material 125. The coupon or voucher may then be used by the shopper to acquire a roll-support adapter 140 at no additional cost. In another embodiment, an effective kit may be provided by providing a coupon or voucher together with a roll-support adapter 140. In this embodiment the coupon or voucher may then be used by the shopper to acquire at least one roll 120 at no additional cost. In yet another embodiment, a coupon or voucher may be provided to a potential shopper through a direct mailing, as a part of a point of sale marketing display, via the internet, or by other means enabling the shopper to acquire the roll-support adapter 140 at no additional cost upon a purchase of the rolls 120, or alternatively, to acquire the rolls 120 upon the purchase of a roll-support adapter 140 at no additional cost.

To provide the benefits of the large diameter rolls 120 to the widest possible market segment of consumers, it is possible to market a variety of kits 100. Within this variety may be included kits 100 comprising roll-support adapters 140 of differing designs and/or colors, and/or materials. Roll-support adapters 140 comprising a means for providing among a variety of scents or a single scent for the consumer to select may be provided. Optional roll-support adapters 140 may be provided capable of dispensing a lotion or other material either for use together with the web material 125 or for use apart from the web material 125.

The marketing method may comprise the optional step of adding indicia 160 to one or more of the components of the kit 100. In one embodiment, similar indicia 160 may be affixed to the roll-support adapter 140, the adapter container 146, the roll 120, the web material 125, and the package 110. The indicia 160 may also be used in point of sale marketing materials as well as advertising copy. FIG. 2 illustrates the addition of similar indicia 160 to the roll-support adapter 140 and the web material 125. In another embodiment, dissimilar indicia 160 may be provided on different components of the kit 100.

The indicia 160 may be molded into one or more surfaces of the roll-support adapter 140. In one embodiment, the indicia 160 may be printed upon a label that is affixed to the roll-support adapter 140, or upon other kit 100 components, as is known in the art. The indicia 160 may be printed onto one or more surfaces of the roll-support adapter 140.The indicia 160 may be printed, embossed or otherwise affixed to one or more surfaces of the adapter container 146, the package 110, and the core 130.

In one embodiment the indicia 160 may be embossed into the web material 125. In another embodiment, the indicia 160 may be printed onto the web material. In yet another embodiment, the indicia 160 may be formed into the web material 125 as the web material is manufactured as is known in the art.

The use of similar indicia 160 serves to tie all of the components together in the mind of the consumer. The indicia 160 also serve as a reference point for the shopper seeking to purchase additional rolls 120 of web material 125 and/or additional roll-support adapters 140. The indicia 160 may be a graphical representation, a brand name or a combination of the two. Colors may be employed as part of the indicia 160 to differentiate particular products from competing products and/or to indicate product features. An exemplary indicia 160 is the brand name Charmin® owned by The Procter & Gamble Company of Cincinnati Ohio. This brand name may be used singly or in conjunction with a brand symbol, such as a bear, to unify the components of the kit.

As an example, the brand name and the symbol may be molded into the roll-support adapter 140. The name and symbol may be printed on the package 110 of the kit, as well as other kit components such as the adapter container 146 and the core end cover 132. The name and symbol may be printed onto the web material 125. The name and/or symbol may also appear in the advertising copy included in the marketing of the kit, both at the point of sale and through other media outlets.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would have been obvious to those skilled in the art that various other changes and modifications can be made without departing from the spirit and scope of the invention. It is therefore intended to cover in the appended claims all such changes and modifications that are within the scope of the invention.

What is claimed is:

1. A convolutely wound paper product dispensing kit comprising a package, the package comprising:

at least one roll of convolutely wound paper product, at least one roll-support adapter capable of supporting the at least one roll of convolutely wound web material paper product and capable of interfacing with a roll-holding fixture having a first single roll capacity, wherein the combination of the at least one roll-support adapter and the roll-holding fixture has a single roll capacity greater than the first single roll capacity, and wherein the at least one roll-support adapter is provided in an adapter container, and wherein the adapter container is unitized by over-wrapping the adapter container and the package.

2. A kit according to claim 1 comprising a plurality of rolls of a convolutely wound paper product.

3. A kit according to claim 1 wherein the wound paper product comprises a width and spaced apart lines of weakness generally transverse to the width.

4. The kit according to claim 1 wherein at least one kit component comprises an indicia.

5. The kit according to claim 1 wherein the adapter container is unitized by over-wrapping the adapter container and the package with shrink wrap.

6. The kit according to claim 1 wherein the adapter container is unitized by over-wrapping the adapter container and the package with stretch wrap.

7. A convolutely wound paper product dispensing kit comprising a package, the package comprising:

at least one roll of convolutely wound paper product, at least one roll-support adapter capable of supporting the at least one roll of convolutely wound web material paper product and capable of interfacing with a roll-holding fixture having a first single roll capacity, wherein the combination of the roll-support adapter and the roll holding fixture has a single roll capacity greater than the first single roll capacity, and wherein the at least one roll-support adapter is provided in an adapter container, and wherein the adapter container is joined to the package by adhesive bonding.

8. A kit according to claim 7 comprising a plurality of rolls of a convolutely wound paper product.

9. A kit according to claim 7 wherein the wound paper product comprises a width and spaced apart lines of weakness generally transverse to the width.

10. The kit according to claim 7 wherein at least one kit component comprises an indicia.

* * * * *